US010024116B2

(12) United States Patent
Veit et al.

(10) Patent No.: US 10,024,116 B2
(45) Date of Patent: Jul. 17, 2018

(54) FLOW DISTRIBUTION ASSEMBLIES WITH SHUNT TUBES AND EROSION-RESISTANT FITTINGS

(71) Applicant: Halliburton Energy Services, Inc., Houston, TX (US)

(72) Inventors: Jan Veit, Plano, TX (US); Stephen Michael Greci, Little Elm, TX (US); Matthew Ryan Gommel, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 299 days.

(21) Appl. No.: 14/760,291

(22) PCT Filed: Aug. 22, 2014

(86) PCT No.: PCT/US2014/052338

§ 371 (c)(1),
(2) Date: Jul. 10, 2015

(87) PCT Pub. No.: WO2016/028322

PCT Pub. Date: Feb. 25, 2016

(65) Prior Publication Data

US 2016/0251908 A1 Sep. 1, 2016

(51) Int. Cl.

| | |
|---|---|
| ***E21B 17/00*** | (2006.01) |
| ***E21B 43/08*** | (2006.01) |
| ***E21B 43/04*** | (2006.01) |

(52) U.S. Cl.

CPC ..... *E21B 17/00* (2013.01); *E21B 43/04* (2013.01); *E21B 43/08* (2013.01)

(58) Field of Classification Search

CPC ..... E21B 17/00; E21B 43/088; E21B 43/08; E21B 43/04

See application file for complete search history.

(56) References Cited

U.S. PATENT DOCUMENTS

| | | | |
|---|---|---|---|
| 5,335,724 | A | 8/1994 | Venditto et al. |
| 5,419,394 | A | 5/1995 | Jones |
| 5,765,642 | A | 6/1998 | Surjaatmadja |
| 5,842,516 | A | 12/1998 | Jones |

(Continued)

FOREIGN PATENT DOCUMENTS

| | | | |
|---|---|---|---|
| CN | 101328793 | A | 12/2008 |
| GB | 640310 | A | 7/1950 |

(Continued)

OTHER PUBLICATIONS

International Search Report and Written Opinion for PCT/US2014/052338 dated May 19, 2015.

*Primary Examiner* — Michael R Wills, III

(74) *Attorney, Agent, or Firm* — McDermott Will & Emery LLP

(57) ABSTRACT

An example shunt tube assembly includes at least one shunt tube that defines an inner flow path for a fluid and provides an upper portion and a lower portion. At least one shunt fitting is positioned inline between the upper and lower portions of the at least one shunt tube. The shunt fitting provides an outlet that fluidly communicates with the inner flow path to provide an exit for at least a portion of the fluid to be discharged from the at least one shunt tube.

24 Claims, 4 Drawing Sheets

(56) References Cited

U.S. PATENT DOCUMENTS

| | | | | |
|---|---|---|---|---|
| 6,491,097 | B1 * | 12/2002 | Oneal | E21B 17/1085 166/169 |
| 7,597,141 | B2 * | 10/2009 | Rouse | E21B 41/0078 166/222 |
| 2005/0284643 | A1 | 12/2005 | Setterberg | |
| 2007/0062686 | A1 * | 3/2007 | Rouse | E21B 41/0078 166/51 |
| 2008/0314588 | A1 * | 12/2008 | Langlais | E21B 41/0078 166/278 |
| 2013/0112399 | A1 | 5/2013 | Royer et al. | |
| 2013/0327542 | A1 | 12/2013 | Least et al. | |
| 2014/0014314 | A1 * | 1/2014 | Cunningham | E21B 43/04 166/51 |
| 2014/0238657 | A1 | 8/2014 | Sladic et al. | |
| 2014/0262332 | A1 * | 9/2014 | McNamee | E21B 43/08 166/378 |
| 2015/0211341 | A1 * | 7/2015 | Least | E21B 43/08 166/227 |

FOREIGN PATENT DOCUMENTS

| | | | |
|---|---|---|---|
| WO | 2013187878 | A1 | 12/2013 |
| WO | 2016028322 | A1 | 2/2016 |

* cited by examiner

FLOW DISTRIBUTION ASSEMBLIES WITH SHUNT TUBES AND EROSION-RESISTANT FITTINGS

BACKGROUND

The present disclosure generally relates to downhole fluid flow control and, more particularly, to flow distribution assemblies used to distribute fluid flow into surrounding subterranean formations.

In the course of completing wellbores that traverse hydrocarbon-bearing portions of subterranean formations, it is oftentimes desirable to inject various types of fluids into the wellbore for a number of purposes. For example, steam is often injected into surrounding formations to stimulate the production of high-viscosity hydrocarbons, and treatment fluids, such as hydrochloric acid, are often injected into a wellbore to react with acid-soluble materials present within the formation and thereby enlarge pore spaces in the formation. In other applications, water or a gas may be injected into the surrounding formations to maintain formation pressures so that a producing well can continue production. In yet other applications, a gravel slurry is deposited in spaced intervals surrounding well screens during gravel-packing operations.

Such fluid injection operations are typically carried out by placing an injection string at a desired location within a wellbore. The injection string oftentimes includes a wellbore screen assembly that includes one or more sand screens arranged about perforated production tubing. The annulus between the sand screens and the wellbore wall is generally gravel-packed to mitigate the influx of formation sands derived from the surrounding subterranean formations. Packers are customarily set above and below sand screen assemblies to seal off the annulus in the zone where production fluids flow into the production tubing. The annulus around the sand screens is then packed with a gravel slurry, which comprises relatively coarse sand or gravel suspended within water or a gel and acts as a filter to reduce the amount of fine formation sand reaching the screens.

During the gravel packing process, annular sand "bridges" can form around the sand screen assembly that may prevent the complete circumscribing of the screen structure with gravel in the completed well. This incomplete screen structure coverage by the gravel may leave an axial portion of the sand screen exposed to the fine formation sand, thereby undesirably lowering the overall filtering efficiency of the sand screen structure.

One approach to overcoming annulus sand bridges has been to incorporate shunt tubes that longitudinally extend across the sand screens. The shunt tubes provide a flow path that allows the inflowing gravel slurry to bypass any sand bridges that may be formed and otherwise permit the gravel slurry to enter the annulus between the sand screens and the wellbore beneath sand bridges, thereby forming the desired gravel pack beneath it.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid flow control and, more particularly, to flow distribution assemblies used to distribute fluid flow into surrounding subterranean formations.

The presently disclosed embodiments enable relatively high rates of fluid flow through a flow distribution assembly during gravel packing and/or formation fracture packing operations. The exemplary flow distribution assemblies described herein include shunt tubes that extend along the exterior of a work string to allow for fluid communication. In some embodiments, the shunt tubes include one or more shunt fittings positioned inline with the shunt tubes and providing a shunt nozzle for discharging fluids, such as a gravel slurry, from the shunt tubes. Advantageously, the shunt fittings may be made of and/or clad with an erosion-resistant material, thereby allowing the flow distribution assemblies to circulate fluids having solid particulates entrained therein while mitigating the adverse effects of erosion. In other embodiments, the shunt tubes may include one or more shunt nozzles that extend from corresponding openings defined in the shunt tubes and thereby providing a flow path for fluids to exit the shunt tubes. In some cases, the shunt nozzles may be recessed into the corresponding openings defined in the shunt tubes, but in other cases the shunt nozzles may be flush mounted on the outer surface of the shunt tubes. Similar to the shunt fittings, the shunt nozzles may be made of and/or clad with an erosion-resistant material.

Figure 1:
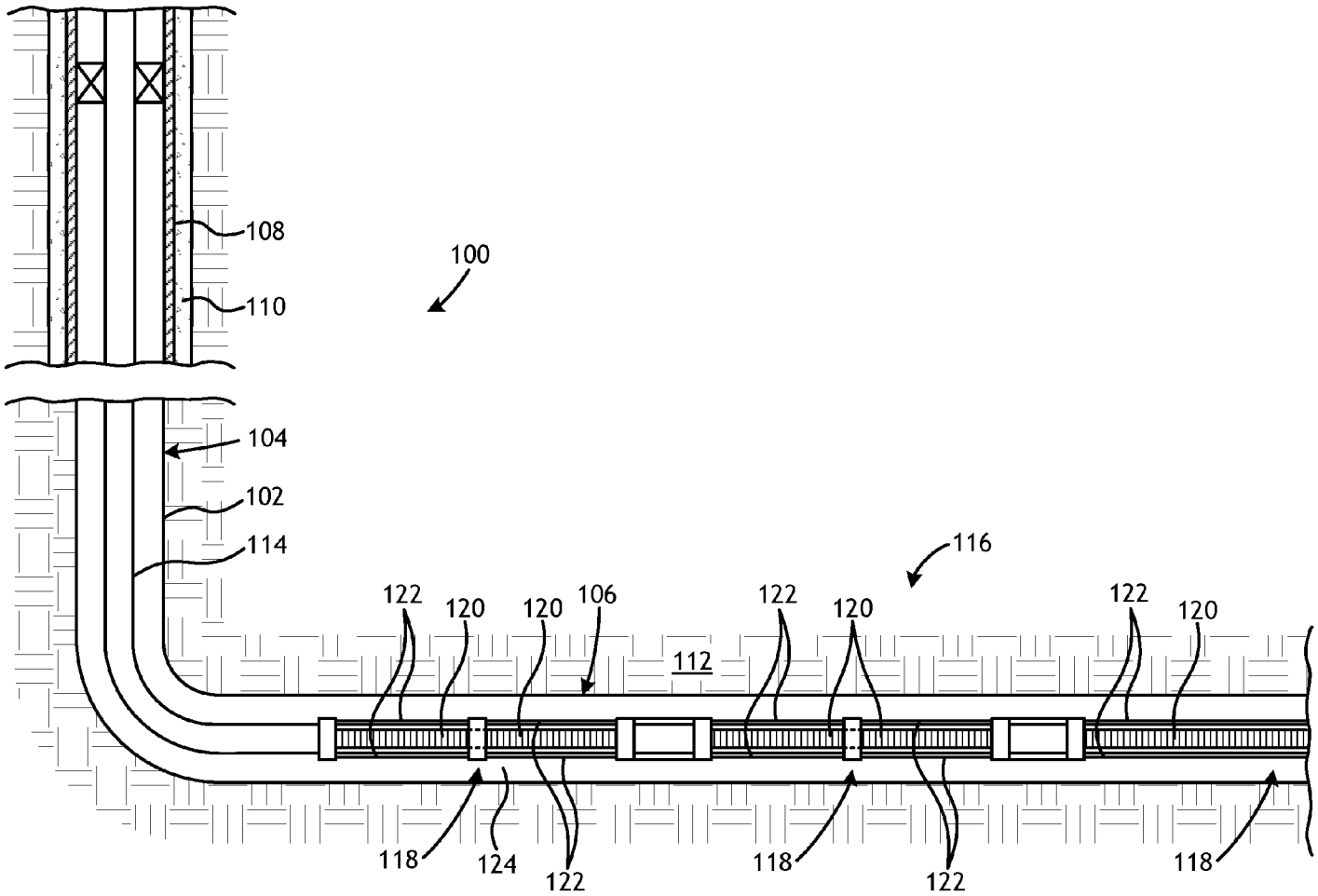
FIG. 1 depicts a well system that can employ one or more principles of the present disclosure.

Referring to FIG. 1, illustrated is an exemplary well system 100 that can employ one or more principles of the present disclosure, according to one or more embodiments. As depicted, the well system 100 includes a wellbore 102 that extends through various earth strata and may have a substantially vertical section 104 that may transition into a substantially horizontal section 106. The upper portion of the vertical section 104 may have a liner or casing string 108 secured therein with, for example, cement 110. The horizontal section 106 may extend through a hydrocarbon bearing subterranean formation 112. As illustrated, the horizontal section 106 may be arranged within or otherwise extend through an open hole section of the wellbore 102. In other embodiments, however, the horizontal section 106 of the wellbore 102 may also be completed using casing 108 or the like, without departing from the scope of the disclosure.

A work string 114 may be positioned within the wellbore 102 and extend from the surface (not shown). The work string 114 provides a conduit for fluids to be conveyed either to or from the formation 112. Accordingly, the work string 114 may be characterized as an injection string in embodiments where fluids are introduced or otherwise conveyed to the formation 112, but may alternatively be characterized as production tubing in embodiments where fluids are extracted from the formation 112 to be conveyed to the surface.

At its lower end, the work string 114 may be coupled to or otherwise form part of a completion assembly 116 generally arranged within the horizontal section 106. As depicted, the completion assembly 116 may include a plurality of flow distribution assemblies 118 axially offset from each other along portions of the completion assembly 116. Each flow distribution assembly 118 may include one or more sand screens 120 disposed about the outer surface of the work string 114. The sand screens 120 may comprise fluid-porous, particulate restricting devices made from a plurality of layers of a wire mesh that are diffusion bonded or sintered together to form a fluid porous wire mesh screen. In other embodiments, however, the sand screens 120 may have multiple layers of a woven wire metal mesh material having a uniform pore structure and a controlled pore size that is determined based upon the properties of the formation 112. For example, suitable woven wire mesh screens may include, but are not limited to, a plain Dutch weave, a twilled Dutch weave, a reverse Dutch weave, combinations thereof, or the like. In other embodiments, however, the sand screens 120 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other sand screen 120 designs are equally suitable, without departing from the scope of the disclosure.

Each flow distribution assembly 118 may further include one or more shunt tubes 122 that extend along the exterior of the work string 114 and the sand screens 120 and otherwise within an annulus 124 defined between the flow distribution assemblies 118 and the wall of the wellbore 102. The shunt tubes 122 may be configured to convey fluids to various fluid flow points along the axial length of the completion assembly 116 so that the fluid can be evenly distributed within an annulus 124 defined between the flow distribution assemblies 118 and the wall of the wellbore 102. Accordingly, the completion assembly 116 may prove useful in several types of wellbore operations including, but not limited to, a gravel-packing operation, a fracture packing operation, and any combination thereof. Accordingly, the fluids that may be conveyed by the shunt tubes 122 may include, but are not limited to, a fracturing fluid, a proppant slurry, a gravel slurry, and any combination thereof.

The shunt tubes 122 may include at least one transport tube that extends along all or substantially all of the completion assembly 116 and may further include one or more packing tubes that extend from the transport tube(s). The transport tube(s) may be open to the annulus 124 at its uphole end to receive the fluid therein to flow along the entire axial length of the transport tube(s). The fluid may enter the annulus 124 via a crossover sub (not shown), or the like, positioned within the work string 114 above the uppermost flow distribution assembly 118. The crossover sub discharges the fluid into the annulus 124 from the interior of the work string 114, and a portion of the fluid is received by transport tube(s). As the fluid flows down the transport tube(s), a portion of the fluid is able to flow into the packing tubes, which split off the transport tube(s) and run substantially parallel thereto along all or a portion of each flow distribution assembly 118. Each packing tube may include one or more openings or outlets (not shown) that are able to discharge the fluid into the annulus 124. In other embodiments, the transport tube(s) may also include one or more openings or outlets (not shown) that are able to discharge the fluid into the annulus 124.

The fluids discharged into the annulus 124 may contain solid particulates, such as gravel, proppant, and other solid debris that, over time, may tend to erode certain surfaces of the shunt tubes 122, such as the openings or outlets that allow the fluid to be discharged into the annulus 124. As such openings erode and enlarge, usually those near the upper end of the shunt tubes 122, more and more of the fluid (e.g., a gravel slurry) will exit through the enlarged openings with less and less of the fluid exiting through the lower, smaller openings in the shunt tubes 122. This increased flow through the larger, eroded openings can cause "sand bridges" (i.e., the accumulation of particulates) to form in the shunt tubes 122, which may block any further substantial downward flow in the affected shunt tubes 122. Once this occurs, no further fluid can be delivered through the affected shunt tube 122 to the downhole portions of the wellbore 102. Another effect of having enlarged or eroded openings due to erosion is a loss of control in the direction of the flow. If the flow is redirected towards the sand screens 120, damage could ensue and thereby cause a loss in filtering capability.

According to the present disclosure, the fluid flow points provided in the shunt tubes 122 may each include a shunt fitting (not shown) and/or a shunt nozzle (not shown). The shunt fittings and the shunt nozzles associated with the shunt tubes 122 may be made of erosion-resistant materials and thereby provide an erosion-resistant exit pathway for fluids to exit the shunt tubes 122 into the annulus 124.

It should be noted that even though FIG. 1 depicts the flow distribution assemblies 118 as being arranged in an open hole portion of the wellbore 102, alternative embodiments are contemplated herein where one or more of the flow distribution assemblies 118 is arranged within a cased portion of the wellbore 102.

Further, even though FIG. 1 depicts the flow distribution assemblies 118 as being arranged in the horizontal section 106 of the wellbore 102, those skilled in the art will readily recognize that the principles of the present disclosure are equally well suited for use in vertical wells, deviated wellbores, slanted wells, multilateral wells, combinations thereof, and the like. As used herein, directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
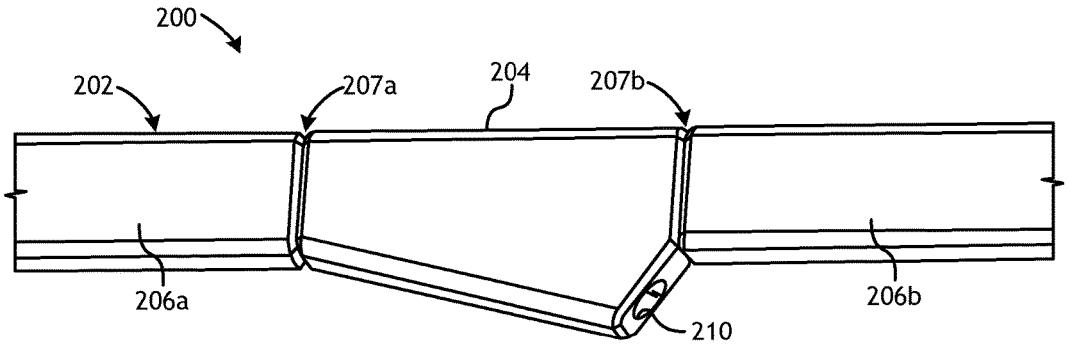
FIGS. 2A and 2B depict isometric and cross-sectional side views, respectively, of an exemplary shunt tube assembly.
Figure 2B:
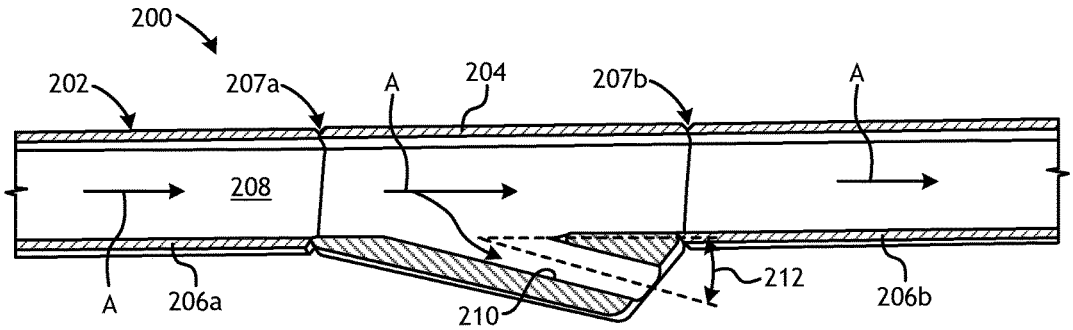

Referring now to FIGS. 2A and 2B, with continued reference to FIG. 1, illustrated are isometric and cross-sectional side views, respectively, of an exemplary shunt tube assembly 200, according to one or more embodiments. The shunt tube assembly 200 (hereafter "assembly 200") may be used in the exemplary well system 100 of FIG. 1. More particularly, the assembly 200 may be positioned or otherwise arranged at various points within one or more of the shunt tubes 122 of the flow distribution assemblies 118 of FIG. 1. As illustrated, the assembly 200 may include a shunt tube 202 and an associated shunt fitting 204. The shunt tube 202 may be the same as or similar to any of the shunt tubes 122 of FIG. 1. Accordingly, the shunt tube 202 may be a transport tube or a packing tube, as described above, and may be configured to convey fluids from the annulus 124 (FIG. 1) to various fluid flow points along the axial length of the completion assembly 116 (FIG. 1).

At least one of the fluid flow points may correspond to the location of the shunt fitting 204. As illustrated, the shunt fitting 204 may be positioned inline in the shunt tube 202. More particularly, the shunt fitting 204 may interpose a first or upper portion 206*a* of the shunt tube 202 and a second or lower portion 206*b* of the shunt tube 202. The shunt fitting 204 may be attached to the upper and lower portions 206*a,b* of the shunt tube 202 at corresponding attachment locations 207*a* and 207*b*, respectively, via a variety of attachment means including, but not limited to, welding, brazing, adhesives, mechanical fastening (e.g., screws, bolts, pins, snap rings, etc.), shrink fitting, or any combination thereof. While only one shunt fitting 204 is shown as positioned inline in the shunt tube 202, it will be appreciated that multiple shunt fittings 204 may be connected inline in the shunt tube 202 to provide a corresponding number of fluid flow point locations.

The shunt tube 202 may be generally tubular or, in other words, in the general shape of a tube or a conduit. As best seen in FIG. 2B, the shunt tube 202 may provide a fluid conduit or inner flow path 208 for the flow of a fluid, as shown by the arrows A. The fluid A may be any of the fluids mentioned above including, but not limited to, a fracturing fluid, a gravel slurry, and any combination thereof. In the illustrated embodiment, the shunt tube 202 and the shunt fitting 204 are depicted as having a generally rectangular cross-sectional shape. In other embodiments, however, the shunt tube 202 and the shunt fitting 204 may alternatively have a circular cross-section or any other polygonal cross-section, such as triangular, square, trapezoidal, or any other polygonal shape. In yet other embodiments, the shunt tube 202 and the shunt fitting 204 may exhibit a cross-sectional shape that is substantially oval or kidney shaped, without departing from the scope of the disclosure.

As illustrated, the shunt fitting 204 may include an outlet 210 that fluidly communicates with the inner flow path 208. The outlet 210 may provide an opening or exit port for at least a portion of the fluid A to be discharged from the assembly 200. In some embodiments, the outlet 210 may be a hole that is flush with the body of the shunt fitting 204. In other embodiments, however, the outlet 210 may comprise a nozzle feature that extends from the body of the shunt fitting 204 at an angle 212 (FIG. 2B). The angle 212 may be any angle ranging between 1° and 179° with respect to the shunt tube 202. In the illustrated embodiment, the angle 212 is about 25° offset from the shunt tube 202, but could equally be greater or smaller than 25°, without departing from the scope of the disclosure.

In order to prevent or otherwise reduce erosion resulting from the circulating fluid A during operation, the shunt fitting 204 may be made of an erosion-resistant material. The erosion-resistant material may be, but is not limited to, a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), or any combination thereof. In other embodiments, or in addition thereto, the interior or inner walls of the shunt fitting 204 may be clad or coated with an erosion-resistant material, such as tungsten carbide, a cobalt alloy, or ceramic. In such embodiments, the outlet 210 of the shunt fitting 204 in particular may be clad or coated with the erosion-resistant material.

In some embodiments, the shunt tube 202 may also be configured to be erosion-resistant or otherwise comprise an erosion-resistant material. For instance, the shunt tube 202 may be made of a carbide or a ceramic. In other embodiments, the shunt tube 202 may be made of a metal or other material that is internally cladded with an erosion-resistant material such as, but not limited to, tungsten carbide, a cobalt alloy, or ceramic. In yet other embodiments, the shunt tube 202 may be made of a material that has been surface hardened, such as surface hardened metals (e.g., via nitriding), heat treated metals (e.g., using 13 chrome), carburized metals, or the like. In even further embodiments, the shunt tube 202, or a portion thereof, may be an Aramid-type fiber tube, such as a Kevlar or other type of composite material.

Figure 3A:
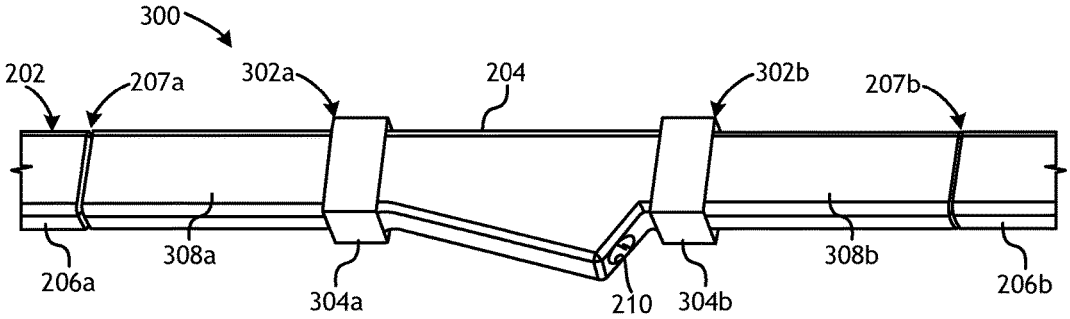
FIGS. 3A and 3B depict isometric and cross-sectional side views, respectively, of another exemplary shunt tube assembly.
Figure 3B:
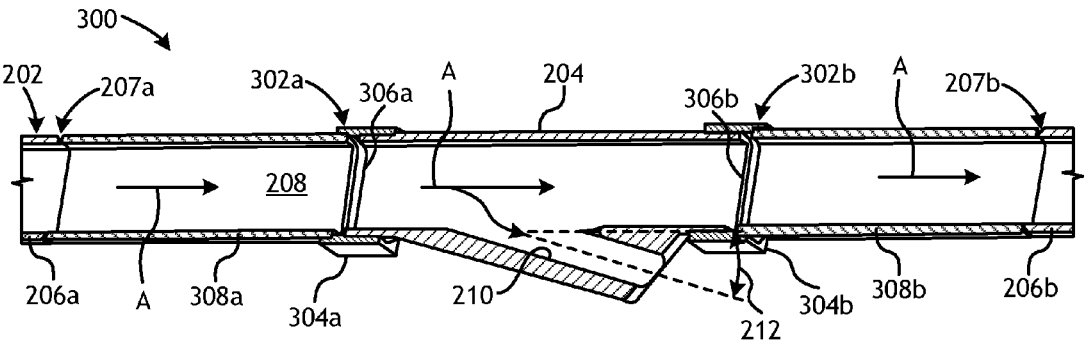

Referring now to FIGS. 3A and 3B, illustrated are isometric and cross-sectional side views, respectively, of another exemplary shunt tube assembly 300, according to one or more embodiments. The shunt tube assembly 300 (hereafter the "assembly 300") may be used in the exemplary well system 100 of FIG. 1 and may be similar in some respects to the assembly 200 of FIGS. 2A-2B and therefore may be best understood with reference thereto, where like numerals indicate like components not described again in detail. Similar to the assembly 200, the assembly 300 may include the shunt tube 202, including the upper and lower portions 206*a,b* thereof. The assembly 300 may also include the shunt fitting 204, including the outlet 210 that fluidly communicates with the inner flow path 208 to provide an exit for at least a portion of the fluid A to be discharged from the shunt tube 202. In some embodiments, as illustrated, the outlet 210 may be a nozzle that extends from the body of the shunt fitting 204 at the angle 212 (FIG. 3B).

Unlike the assembly 200 of FIGS. 2A-2B, however, the assembly 300 may further include a first or upper coupling assembly 302*a* and a second or lower coupling assembly 302*b*. The upper coupling assembly 302*a* may include an upper coupling 304*a* and the lower coupling assembly 302*b* may include a lower coupling 304*b*. The upper and lower couplings 304*a,b* may be configured to be coupled or otherwise attached to opposing ends of the shunt fitting 204. More particularly, a first or upper end 306*a* of the shunt fitting 204 may be coupled to the upper coupling 304*a*, and a second or lower end 306*b* of the shunt fitting 204 may be coupled to the lower coupling 304*b*. The upper and lower couplings 304*a,b* may be coupled to the upper and lower ends 306*a,b* of the shunt fitting 204, respectively, via a variety of attachment means including, but not limited to, welding, brazing, adhesives, mechanical fastening (e.g., screws, bolts, pins, snap rings, etc.), shrink fitting, or any combination thereof.

In some embodiments, the upper and lower couplings 304*a,b* may be directly coupled or otherwise attached to the upper and lower portions 206*a,b* of the shunt tube 202, respectively, such as via welding, brazing, adhesives, mechanical fastening (e.g., screws, bolts, pins, snap rings, etc.), shrink fitting, or any combination thereof. In other embodiments, however, one or both of the upper and lower coupling assemblies 302*a,b* may include an extension, such as an upper extension 308*a* and/or a lower extension 308*b*. The upper and lower extensions 308*a,b* may be similar in cross-sectional shape to the shunt tube 202. At one end, the upper and lower extensions 308*a,b* may be coupled or otherwise attached to the upper and lower couplings 304*a,b*, respectively, and at the other end, the upper and lower extensions 308*a,b* may be coupled or otherwise attached to the upper and lower portions 206*a,b* of the shunt tube 202, respectively. Such coupling engagements of the upper and lower extensions 308*a,b* with the upper and lower couplings 304*a,b* and the upper and lower portions 206*a,b* of the shunt tube 202 may be accomplished via any one of welding, brazing, adhesives, mechanical fastening (e.g., screws, bolts, pins, snap rings, etc.), shrink fitting, or any combination thereof.

Those skilled in the art will readily appreciate the advantage that the assembly 300 may provide to a well operator. For instance, the upper and lower coupling assemblies 302*a,b* may allow the shunt fitting 204 to be coupled to the upper and lower couplings 304*a,b*, and optionally the upper and lower extensions 308*a,b*, offsite prior to being delivered to a well site. This may allow a manufacturer to properly braze the upper and lower couplings 304*a,b* to the shunt fitting 204, which may be made of a material that is difficult to weld, such as tungsten carbide. Once on site, the upper and lower coupling assemblies 302*a,b* may be coupled to the upper and lower portions 206*a,b* of the shunt tube 202, respectively, using common attachment means, such as welding or brazing techniques, an adhesive, a mechanical fastener, shrink fitting, and any combination thereof.

Figure 4A:
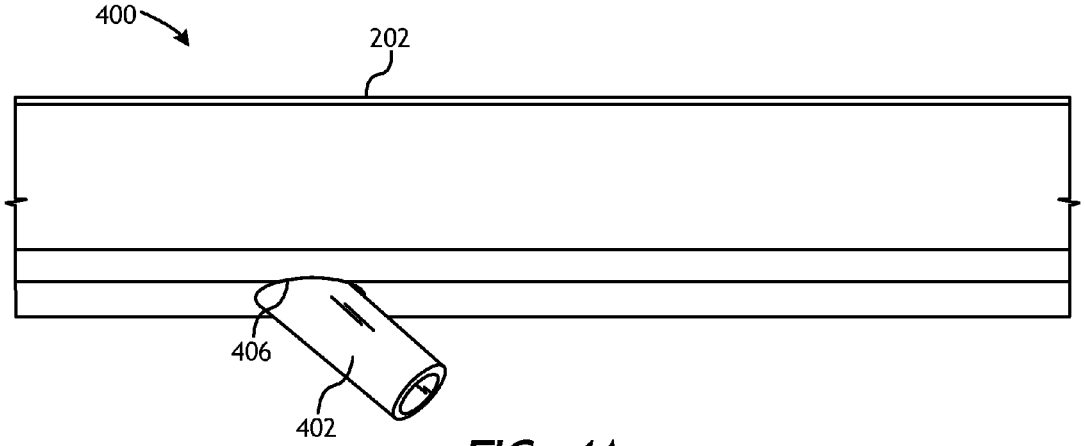
FIGS. 4A-4C depict views of yet another exemplary shunt tube assembly.
Figure 4B:
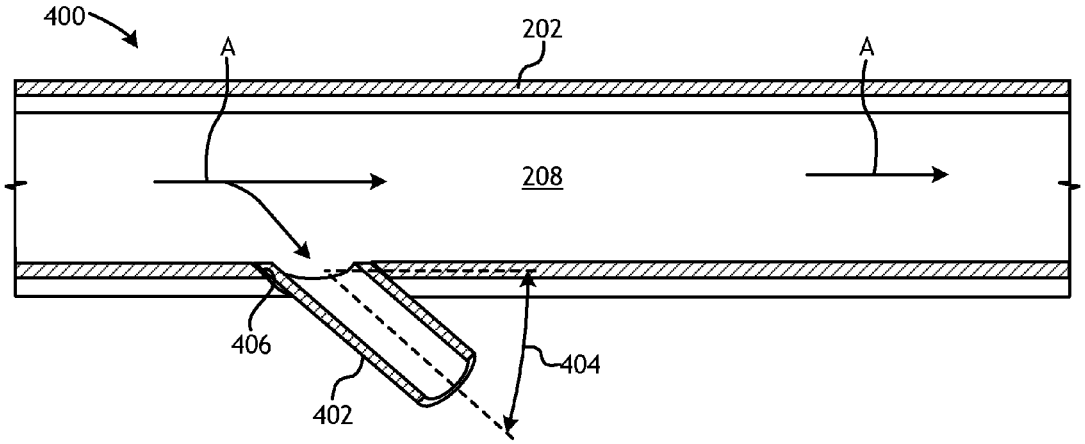
Figure 4C:
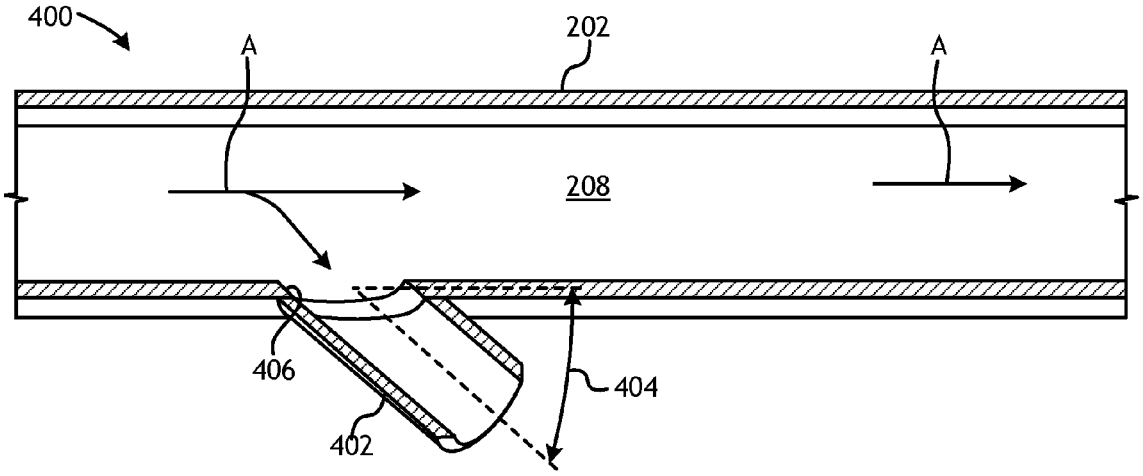

Referring now to FIGS. 4A-4C, illustrated are various views of yet another exemplary shunt tube assembly 400, according to one or more embodiments. More particularly, FIG. 4A depicts an isometric view of the shunt tube assembly 400 (hereafter the "assembly 400"), FIG. 4B depicts a cross-sectional side view of one embodiment of the assembly 400, and FIG. 4C depicts a cross-sectional side view of a second embodiment of the assembly 400. The assembly 400 may be used in the exemplary well system 100 of FIG. 1 and may be similar in some respects to the assemblies 200 and 300 of FIGS. 2A-2B and 3A-3B and therefore may be best understood with reference thereto, where like numerals indicate like components not described again.

Similar to the assemblies 200 and 300 of FIGS. 2A-2B and 3A-3B, the assembly 400 may include the shunt tube 202 for conveying the fluid A therethrough. Unlike the assemblies 200 and 300, however, the assembly 400 may further include a shunt nozzle 402 that extends from the shunt tube 202 at an angle 404 (FIGS. 4B and 4C) that provides an exit for at least a portion of the fluid A to be discharged from the assembly 400. The angle 404 may be any angle ranging between 1° and 179° with respect to the shunt tube 202. In the illustrated embodiment, the angle 404 is about 45° offset from the shunt tube 202, but could equally be greater or smaller than 45°, without departing from the scope of the disclosure.

The shunt nozzle 402 may be a substantially tubular structure that fluidly communicates with an opening 406 defined in the shunt tube 202. The opening 406 may provide fluid communication between the inner flow path 208 of the shunt tube 202 and an exterior thereof. In some embodiments, as illustrated, the shunt nozzle 402 may have a generally circular or cylindrical cross-sectional shape. In other embodiments, however, the shunt nozzle 402 may alternatively have a polygonal cross-sectional shape, such as triangular, square, rectangular, trapezoidal, or any other polygonal shape. In yet other embodiments, the shunt nozzle 402 may exhibit a cross-sectional shape that is substantially oval or kidney shaped, without departing from the scope of the disclosure.

Similar to the shunt fitting 204 of FIGS. 2A-2B and 3A-3B, the shunt nozzle 402 may also be made of an erosion-resistant material, such as those discussed above. In other embodiments, or in addition thereto, the interior or inner surfaces of the shunt nozzle 402 may be clad or coated with an erosion-resistant material, such as tungsten carbide, a cobalt alloy, or ceramic. In some embodiments, the erosion-resistant material may be applied to the inner surfaces of the shunt nozzle 402 before the shunt nozzle 402 is coupled to the shunt tube 202. In other embodiments, the erosion-resistant material may be applied to the inner surfaces of the shunt nozzle 402 after the shunt nozzle 402 is coupled to the shunt tube 202, without departing from the scope of the disclosure.

In the embodiment shown in FIG. 4B, the shunt nozzle 402 is depicted as being inserted into the opening 406 and otherwise coupled to the shunt tube 202 as recessed into the opening 406. In such embodiments, the shunt nozzle 402 may be coupled to the shunt tube 202 within the opening 406 via a variety of attachment means including, but not limited to, welding, brazing, adhesives, mechanical fastening (e.g., screws, bolts, pins, snap rings, etc.), shrink fitting, or any combination thereof.

In the embodiment shown in FIG. 4C, the shunt nozzle 402 is depicted as being aligned with the opening 406 and flush mounted to the outer surface of the shunt tube 202. In such embodiments, the shunt nozzle 402 may be coupled or otherwise attached to the outer surface of the shunt tube 202 via one or more of welding, brazing, adhesives, mechanical fastening (e.g., screws, bolts, pins, snap rings, etc.), shrink fitting, or any combination thereof.

While the assemblies 200, 300, 400 described herein are generally described with reference to injection operations, where a fluid A is injected into a surrounding formation 112 (FIG. 1) via the shunt tubes 202 and associated shunt fittings 204 or shunt nozzles 402, those skilled in the art will readily appreciate that the assemblies 200, 300, 400 may equally be used in production operations (e.g., reverse-flow operations), without departing from the scope of the disclosure. For example, in other embodiments, the flow of another fluid (not shown), such as a formation fluid, may instead be drawn into the shunt tubes 202 via the shunt fittings 204 or shunt nozzles 402 and subsequently into the inner flow path 208 to be produced to the surface. Advantageously, the erosion-resistant characteristics of the shunt tubes 202 and the shunt fittings 204 and shunt nozzles 402 allow the fluids to be produced without causing detrimental eroding.

Embodiments disclosed herein include:

A. A shunt tube assembly that includes at least one shunt tube defining an inner flow path for a fluid and providing an upper portion and a lower portion, and at least one shunt fitting positioned inline between the upper and lower portions of the at least one shunt tube, the at least one shunt fitting providing an outlet that fluidly communicates with the inner flow path to provide an exit for at least a portion of the fluid to be discharged from the at least one shunt tube.

B. A method that includes introducing a flow distribution assembly into a wellbore on a work string, the flow distribution assembly including at least one shunt tube extending along an exterior of the work string and defining an inner flow path for a fluid, the at least one shunt tube providing an upper portion and a lower portion, conveying the fluid into the at least one shunt tube from an annulus defined between the work string and the wellbore, and discharging at least a portion of the fluid from the at least one shunt tube at a shunt fitting positioned inline between the upper and lower portions of the at least one shunt tube, the shunt fitting providing an outlet that fluidly communicates with the inner flow path.

C. A shunt tube assembly that includes at least one shunt tube defining an inner flow path for a fluid and defining an opening that provides fluid communication between the inner flow path and an exterior of the at least one shunt tube, and a shunt nozzle aligned with the opening and mounted to an outer surface of the at least one shunt tube, the shunt nozzle fluidly communicating with the inner flow path to provide an exit for at least a portion of the fluid to be discharged from the at least one shunt tube.

Each of embodiments A, B, and C may have one or more of the following additional elements in any combination: Element 1: wherein the fluid is selected from the group consisting of a fracturing fluid, a gravel slurry, and any combination thereof. Element 2: wherein the at least one shunt fitting is coupled to the upper and lower portions of the at least one shunt tube by at least one of welding, brazing, an adhesive, a mechanical fastener, shrink fitting, and any combination thereof. Element 3: wherein a cross-sectional shape of the at least one shunt tube is at least one of circular, polygonal, oval, and kidney-shaped. Element 4: wherein the at least one shunt fitting comprises an erosion-resistant material selected from the group consisting of a carbide, a ceramic, a cobalt alloy, and a surface-hardened metal. Element 5: wherein the at least one shunt tube comprises an erosion-resistant material selected from the group consisting of a carbide, a ceramic, a cobalt alloy, a surface-hardened metal, and a composite. Element 6: wherein an inner surface of at least one of the at least one shunt fitting and the at least one shunt tube is clad with an erosion-resistant material selected from the group consisting of a carbide, a cobalt alloy, and a ceramic. Element 7: further comprising a first coupling assembly including a first coupling attached to a first end of the shunt fitting, and a second coupling assembly including a second coupling attached to a second end of the shunt fitting. Element 8: wherein the first and second couplings are attached to the first and second ends of the shunt fitting, respectively, by at least one of welding, brazing, an adhesive, a mechanical fastener, shrink fitting, and any combination thereof. Element 9: wherein one or both of the first and second couplings are directly attached to the upper and lower portions of the shunt tube, respectively. Element 10: further comprising an upper extension included in the first coupling assembly and extending between the first coupling and the upper portion of the shunt tube, and a lower extension included in the second coupling assembly and extending between the second coupling and the lower portion of the shunt tube. Element 11: wherein the outlet comprises a nozzle that extends from the shunt fitting at an angle. Element 12: further comprising a work string extendable within a wellbore, wherein the at least one shunt tube extends along an exterior of the work string, and one or more sand screens disposed about a portion of the work string and interposing the work string and the one or more shunt tubes.

Element 13: wherein the fluid is selected from the group consisting of a fracturing fluid, a gravel slurry, and any combination thereof. Element 14: further comprising preventing erosion of the shunt fitting, wherein the shunt fitting comprises an erosion-resistant material selected from the group consisting of a carbide, a ceramic, a cobalt alloy, and a surface-hardened metal. Element 15: further comprising preventing erosion of the at least one shunt tube, wherein the at least one shunt tube comprises an erosion-resistant material selected from the group consisting of a carbide, a ceramic, a cobalt alloy, a surface-hardened metal, and a composite. Element 16: further comprising preventing erosion of an inner surface of at least one of the shunt fitting and the at least one shunt tube, wherein the inner surface of the at least one of the shunt fitting and the at least one shunt tube is clad with an erosion-resistant material selected from the group consisting of a carbide, a cobalt alloy, and a ceramic.

Element 17: wherein the shunt nozzle extends from the at least one shunt tube at an angle ranging between 1° and 179° with respect to the at least one shunt tube. Element 18: wherein a cross-sectional shape of the shunt nozzle is at least one of circular, polygonal, oval, and kidney-shaped. Element 19: wherein the shunt nozzle comprises an erosion-resistant material selected from the group consisting of a carbide, a ceramic, a cobalt alloy, and a surface-hardened metal. Element 20: wherein the at least one shunt tube comprises an erosion-resistant material selected from the group consisting of a carbide, a ceramic, a cobalt alloy, a surface-hardened metal, and a composite. Element 21: wherein an inner surface of at least one of the shunt nozzle and the at least one shunt tube is clad with an erosion-resistant material selected from the group consisting of a carbide, a cobalt alloy, and a ceramic. Element 22: wherein the shunt nozzle is secured to the outer surface of the at least one shunt tube by at least one of welding, brazing, an adhesive, a mechanical fastener, shrink fitting, and any combination thereof.

By way of non-limiting example, exemplary combinations applicable to A, B, C include: Element 7 with Element 8; Element 7 with Element 9; and Element 7 with Element 10.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A shunt tube assembly, comprising:

at least one shunt tube defining an inner flow path for a fluid and providing an upper portion and a lower portion;

at least one shunt fitting positioned inline between the upper and lower portions of the at least one shunt tube, the at least one shunt fitting providing an outlet that fluidly communicates with the inner flow path to provide an exit for at least a portion of the fluid to be discharged from the at least one shunt tube;

a first coupling assembly including a first coupling fixedly attached to a first end of the shunt fitting at a position between the upper and lower portions of the at least one shunt tube; and a second coupling assembly including a second coupling fixedly attached to a second end of the shunt fitting at a position between the upper and lower portions of the at least one shunt tube.

2. The shunt tube assembly of claim 1, wherein the fluid is selected from the group consisting of a fracturing fluid, a gravel slurry, and any combination thereof.

3. The shunt tube assembly of claim 1, wherein the at least one shunt fitting is coupled to the upper and lower portions of the at least one shunt tube by at least one of welding, brazing, an adhesive, a mechanical fastener, shrink fitting, and any combination thereof.

4. The shunt tube assembly of claim 1, wherein a cross-sectional shape of the at least one shunt tube is at least one of circular, polygonal, oval, and kidney-shaped.

5. The shunt tube assembly of claim 1, wherein the at least one shunt fitting comprises an erosion-resistant material selected from the group consisting of a carbide, a ceramic, a cobalt alloy, and a surface-hardened metal.

6. The shunt tube assembly of claim 1, wherein the at least one shunt tube comprises an erosion-resistant material selected from the group consisting of a carbide, a ceramic, a cobalt alloy, a surface-hardened metal, and a composite.

7. The shunt tube assembly of claim 1, wherein an inner surface of at least one of the at least one shunt fitting and the at least one shunt tube is clad with an erosion-resistant material selected from the group consisting of a carbide, a cobalt alloy, and a ceramic.

8. The shunt tube assembly of claim 1, wherein the first and second couplings are attached to the first and second ends of the shunt fitting, respectively, by at least one of welding, brazing, an adhesive, a mechanical fastener, shrink fitting, and any combination thereof.

9. The shunt tube assembly of claim 1, wherein one or both of the first and second couplings are directly attached to the upper and lower portions of the shunt tube, respectively.

10. The shunt tube assembly of claim 1, further comprising:

an upper extension included in the first coupling assembly and extending between the first coupling and the upper portion of the shunt tube; and a lower extension included in the second coupling assembly and extending between the second coupling and the lower portion of the shunt tube.

11. The shunt tube assembly of claim 1, wherein the outlet comprises a nozzle that extends from the shunt fitting at an angle.

12. The shunt tube assembly of claim 1, further comprising:

a work string extendable within a wellbore, wherein the at least one shunt tube extends along an exterior of the work string; and one or more sand screens disposed about a portion of the work string and interposing the work string and the one or more shunt tubes.

13. A method, comprising:

introducing a flow distribution assembly into a wellbore on a work string, the flow distribution assembly including at least one shunt tube extending along an exterior of the work string and defining an inner flow path for a fluid, the at least one shunt tube providing an upper portion and a lower portion;

conveying the fluid from the at least one shunt tube into an annulus defined between the work string and the wellbore; and discharging at least a portion of the fluid from the at least one shunt tube at a shunt fitting positioned inline between the upper and lower portions of the at least one shunt tube, the shunt fitting providing an outlet that fluidly communicates with the inner flow path, wherein:

a first end of the shunt fitting is fixedly coupled to a first coupling at a position between the upper and lower portions of the at least one shunt tube; and a second end of the shunt fitting is fixedly coupled to a second coupling at a position between the upper and lower portions of the at least one shunt tube.

14. The method of claim 13, wherein the fluid is selected from the group consisting of a fracturing fluid, a gravel slurry, and any combination thereof.

15. The method of claim 13, further comprising preventing erosion of the shunt fitting, wherein the shunt fitting comprises an erosion-resistant material selected from the group consisting of a carbide, a ceramic, a cobalt alloy, and a surface-hardened metal.

16. The method of claim 13, further comprising preventing erosion of the at least one shunt tube, wherein the at least one shunt tube comprises an erosion-resistant material selected from the group consisting of a carbide, a ceramic, a cobalt alloy, a surface-hardened metal, and a composite.

17. The method of claim 13, further comprising preventing erosion of an inner surface of at least one of the shunt fitting and the at least one shunt tube, wherein the inner surface of the at least one of the shunt fitting and the at least one shunt tube is clad with an erosion-resistant material selected from the group consisting of a carbide, a cobalt alloy, and a ceramic.

18. A shunt tube assembly, comprising:

at least one shunt tube defining an inner flow path for a fluid and defining an opening that provides fluid communication between the inner flow path and an exterior of the at least one shunt tube; and a shunt nozzle extending from a body of a shunt fitting positioned inline between upper and lower portions of the at least one shunt tube, the shunt nozzle aligned with the opening and mounted to an outer surface of the at least one shunt tube, the shunt nozzle fluidly communicating with the inner flow path to provide an exit for at least a portion of the fluid to be discharged from the at least one shunt tube, wherein:

a first end of the shunt fitting is fixedly coupled to a first coupling at a position between the upper and lower portions of the at least one shunt tube; and a second end of the shunt fitting is fixedly coupled to a second coupling at a position between the upper and lower portions of the at least one shunt tube.

19. The shunt tube assembly of claim 18, wherein the shunt nozzle extends from the at least one shunt tube at an angle ranging between 1° and 179° with respect to the at least one shunt tube.

20. The shunt tube assembly of claim 18, wherein a cross-sectional shape of the shunt nozzle is at least one of circular, polygonal, oval, and kidney-shaped.

21. The shunt tube assembly of claim 18, wherein the shunt nozzle comprises an erosion-resistant material selected from the group consisting of a carbide, a ceramic, a cobalt alloy, and a surface-hardened metal.

22. The shunt tube assembly of claim 18, wherein the at least one shunt tube comprises an erosion-resistant material selected from the group consisting of a carbide, a ceramic, a cobalt alloy, a surface-hardened metal, and a composite.

23. The shunt tube assembly of claim 18, wherein an inner surface of at least one of the shunt nozzle and the at least one shunt tube is clad with an erosion-resistant material selected from the group consisting of a carbide, a cobalt alloy, and a ceramic.

24. The shunt tube assembly of claim 18, wherein the shunt nozzle is secured to the outer surface of the at least one shunt tube by at least one of welding, brazing, an adhesive, a mechanical fastener, shrink fitting, and any combination thereof.

* * * * *